US005155287A

United States Patent [19]

Mason

[11] Patent Number: 5,155,287

[45] Date of Patent: Oct. 13, 1992

[54] PERCUSSION RHYTHM APPARATUS

[76] Inventor: Michael J. Mason, 604 Primrose, Schaumburg, Ill. 60194

[21] Appl. No.: 661,385

[22] Filed: Feb. 26, 1991

[51] Int. Cl.[5] ..... G10D 13/08

[52] U.S. Cl. ..... 84/410; 84/421; 272/74; 446/418; 446/421

[58] Field of Search ..... 84/402, 403, 404, 421, 84/410; 354/293; 446/418, 421, 422; 248/188.1, 188.2, 188.5, 188.6; 272/74, 72; 138/103

[56] References Cited

U.S. PATENT DOCUMENTS

| | | | |
|---|---|---|---|
| 1,042,678 | 10/1912 | Hofer | 446/421 |
| 1,333,242 | 3/1920 | Boryk | 446/418 |
| 2,505,882 | 5/1950 | Cassato | 84/421 |
| 2,531,778 | 11/1950 | Merner | 248/188.5 |
| 2,744,712 | 5/1956 | Brandt | 248/188.5 |
| 3,490,767 | 1/1970 | Rubin | 272/74 |
| 3,904,197 | 9/1975 | Canonge | 272/74 |
| 4,029,246 | 6/1977 | Woodruff | 354/293 X |
| 4,241,988 | 12/1980 | Lepp | 354/293 |

FOREIGN PATENT DOCUMENTS

| | | | |
|---|---|---|---|
| 2163965 | 3/1986 | United Kingdom | 272/72 |

*Primary Examiner*—W. B. Perkey
*Assistant Examiner*—Cassandra Spyrou
*Attorney, Agent, or Firm*—Kajane McManus

[57] ABSTRACT

The percussion rhythm apparatus includes an elongate base member to which one end of each of two hollow tubular members is engaged in a pivotable manner. The tubular members are spaced from one another and both extend outwardly to one side of the base member. The free end of each tubular member includes an angled graspable section, the open end of which is covered by an end cap. The graspable sections are of unequal length to protect fingers from pinching when the tubular members are brought together.

8 Claims, 2 Drawing Sheets

PERCUSSION RHYTHM APPARATUS

BACKGROUND OF THE INVENTION

The present invention relates to an apparatus which may be used by one person to create a rhythm therewith. More particularly, the apparatus includes two hollow elongate tubular members which are pivotably engaged to a base member and may be manipulated by a single person to produce a desired rhythm by percussion of the members against an underlying surface as well as against one another.

PRIOR ART

The use of hollow elongate tubular members, such as in the form of sticks, as a percussion instrument for creating a particular rhythm, has long been known.

For instance a Philippine custom, identified as tininkling, requires three people. Two people hold opposite ends of hollow sticks and click them against beater boards set thereunder, as well as against one another to create two distinct sounds within the particular rhythm being beaten out. The third person dances to the rhythm created, traversing between and over the sticks as required by custom.

The art of tininkling is used by physical education departments to teach students to move rhythmically, thereby improving coordination.

Since presently available tininkling, or rhythm, sticks require an operator at each end, a great deal of time is taken up during classroom participation in training the two operators to synchronize use of the sticks, decreasing the time available in teaching the dancer coordination.

By using the percussion rhythm apparatus of the present invention, only one person is required for beating or tapping out a rhythm and thus the need for synchronization is eliminated, allowing for class time to be used more efficiently in training of the dancing partner.

SUMMARY OF THE INVENTION

According to the invention there is provided a percussion rhythm apparatus comprising an elongate base member to which one end of each of two elongate hollow tubular members are engaged in a pivotable manner. The elongate tubular members are engaged to the base in a spaced apart manner and can be pivoted against and away from one another as well as upwardly and downwardly against a supporting surface to create a rhythm, by percussion, including two different sounds.

DESCRIPTION OF THE PREFERRED EMBODIMENT

Figure 1:
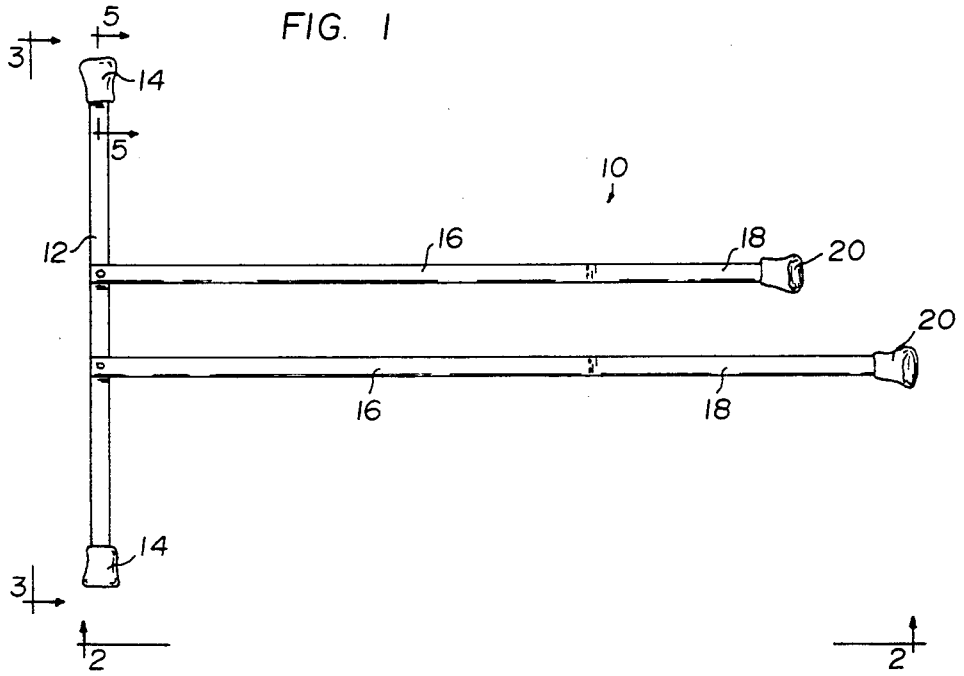
FIG. 1 is a top plan view of the apparatus of the present invention.

Referring now to the drawings in greater detail, FIG. 1 is a top plan view of the percussion rhythm apparatus 10 of the present invention.

Figure 2:
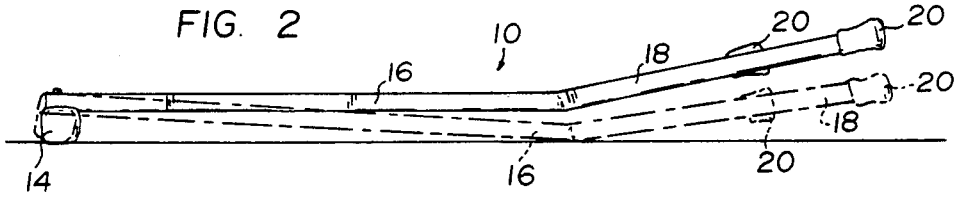
FIG. 2 is a side view of the apparatus showing tubular percussion members thereof being pivoted against a support surface thereunder in phantom.

As shown, the apparatus 10 includes a base member 12 having a foot 14 at each end thereof and two pivotably mounted hollow tubular percussion members 16 extending laterally therefrom in spaced apart fashion. By provision of the feet 14, the base member 12 is fashioned so it can pivot slightly thereupon, as required, and as best illustrated in FIG. 2.

Each tubular member 16 has an upwardly curved graspable free end portion 18 which terminates in an open end 19 having a cap 20 secured thereover.

Further, the graspable free end portions 18 of the tubular percussion members 16 are seen to be of uneven length. The graspable end portions 18 have been constructed in this manner so that pinching of fingers when the tubular percussion members 16 are brought together is minimized.

Figure 3:
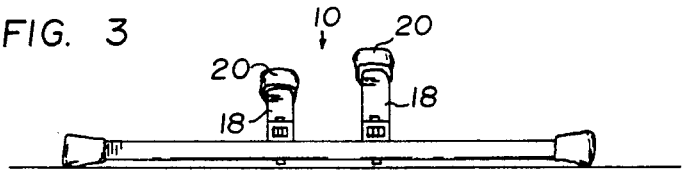
FIG. 3 is a view of the apparatus when looking at same from an end incorporating a base member thereof.
Figure 4:
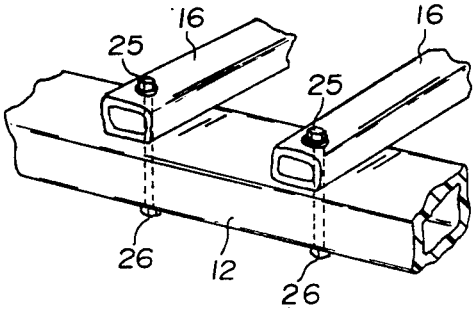
FIG. 4 is an enlarged perspective view of the area of the base member where the tubular percussion members are engaged thereto.

In FIG. 3, the base member 12 is shown to be slightly elevated by the feet 14, above a support surface, usually a floor, upon which the apparatus 10 is placed. The tubular percussion members 16 are shown to be engaged, in spaced apart fashion, about a longitudinal center point of the base member 12 and are, in the preferred embodiment, secured to the base member 12 approximately two inches apart.

The members 16 are shown to be engaged to the base member 12 by means of a bolt 25 extending through the thickness of the member 16, as well as through the thickness of the base member 12. Over an outwardly downwardly extending end of the bolt 25, a nut 26 is placed to secure the structures together. Although this simple method of engagement is preferred, this is not to be construed as limiting.

Figure 5:
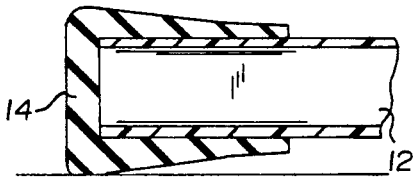
FIG. 5 is an enlarged cross sectional view through a graspable end of one of the tubular members.

FIG. 5 provides an enlarged cross sectional view through one end of the base member 12 and shows the simple slide on engagement of the foot 14 thereover.

Figure 6:
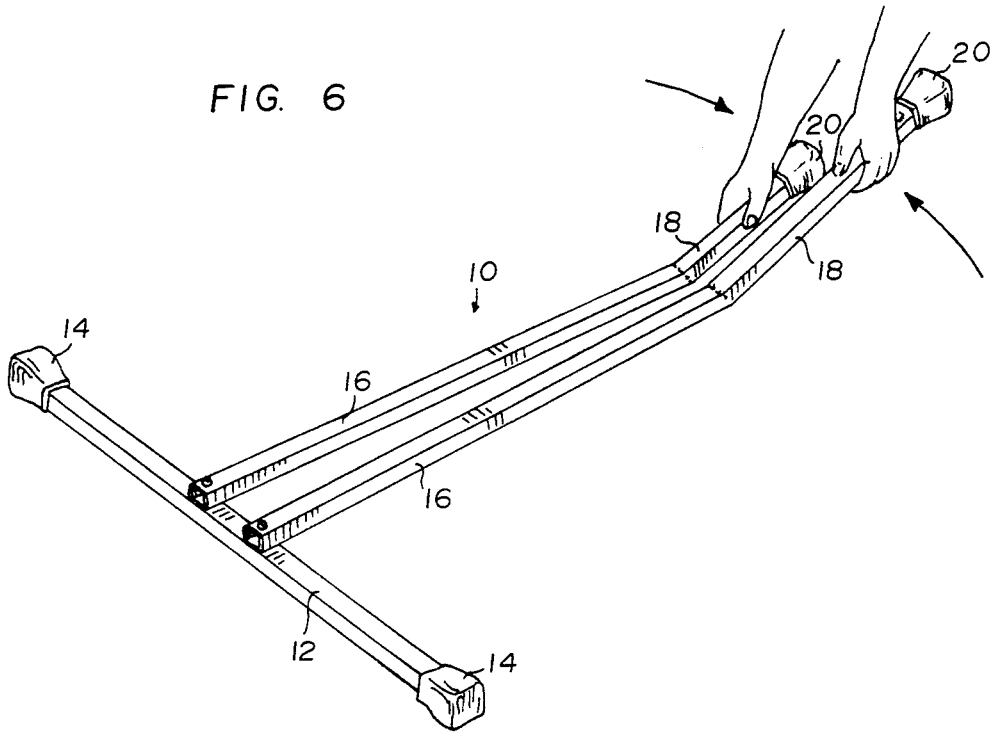
FIG. 6 is a perspective view of the apparatus of the present invention showing the base member on the support surface and the tubular percussion members being pivoted against one another.
Figure 7:
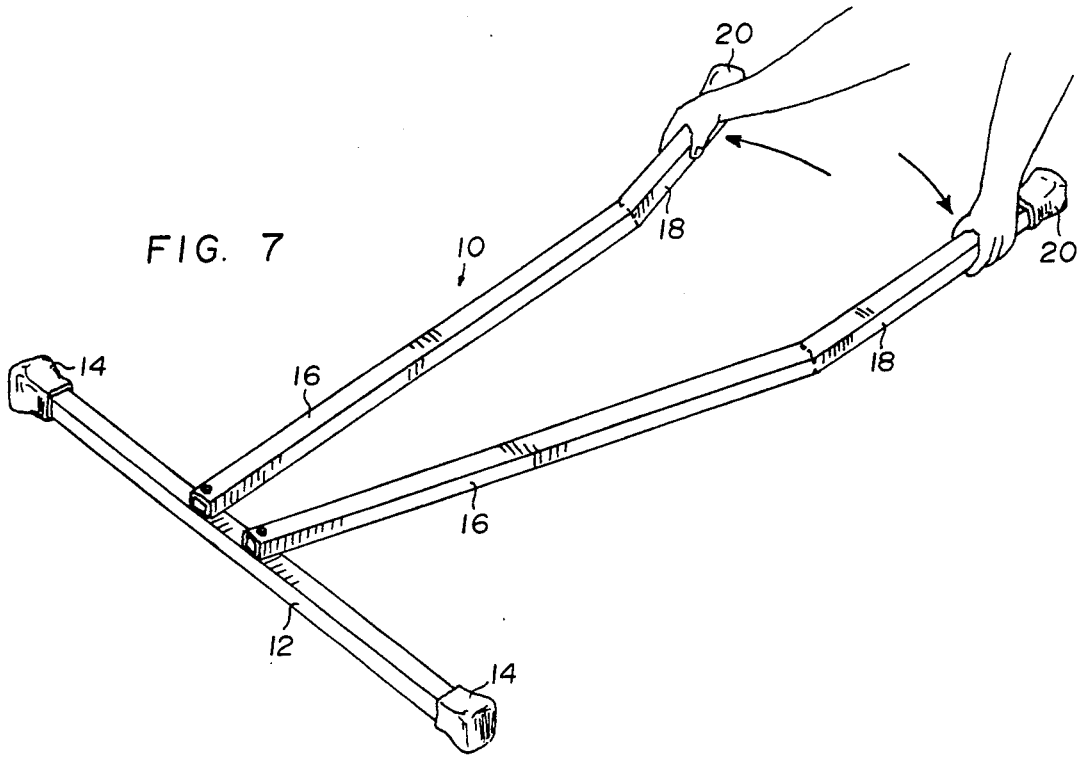
FIG. 7 is a perspective view similar to FIG. 6 but showing the tubular percussion members being pivoted apart and downwardly into contact with the support surface therebeneath.

The use of the apparatus 10 is best illustrated in FIGS. 6 and 7.

As an example, one very commonly found rhythm is a three beat rhythm where the tubular members 16 are first brought together, creating one beat and a particular corresponding sound. Then, the tubular members 16 are separated, pivoted downwardly and tapped against a support surface beneath the apparatus 10 twice, creating two more beats having a sound differing from that created when the tubular members 16 are tapped against one another.

As described above, the device of the present invention has a number of advantages, some of which have been described above and others of which are inherent in the invention.

Also modifications can be proposed to the apparatus 10 without departing from the teachings of the present invention. Accordingly the scope of the invention is only to be limited as necessitated by the accompanying claims.

I claim:

1. An apparatus for use by a single individual in beating out a rhythm against a supporting surface for the apparatus incorporating an elongate base member and two spaced apart hollow tubular members, one end of each of said tubular members being pivotably engaged to said base member and said tubular members extending from their point of attachment to said base member, to one side of said base member, each tubular member having a graspable free end portion including a cap member mounted thereover and being angled in a direction opposite the base member and maintained at all times above said supporting surface, and wherein said graspable end portions are of unequal length.

2. The apparatus of claim 1, wherein said base member includes a foot at each end thereof.

3. The apparatus of claim 2, wherein said tubular members are attached to said base member by means of a nut and bolt construction.

4. The apparatus of claim 3, wherein said tubular members are spaced approximately 2 inches apart about the longitudinal center point of the base member.

5. The apparatus of claim 4, wherein said base member is a hollow tubular member.

6. The apparatus of claim 5, wherein said hollow tubular members are square in cross section.

7. The apparatus of claim 5, wherein said hollow tubular members are round in cross section.

8. The apparatus of claim 5, wherein said tubular are made of plastic.

* * * * *